US007527081B2

(12) United States Patent
Coates

(10) Patent No.: US 7,527,081 B2
(45) Date of Patent: May 5, 2009

(54) CARD HOLDER AND BILLFOLD

(76) Inventor: Jeff D. Coates, 270 Queen's Quay West, # 2204, Toronto, Ontario (CA)

( * ) Notice: Subject to any disclaimer, the term of this patent is extended or adjusted under 35 U.S.C. 154(b) by 766 days.

(21) Appl. No.: 10/869,884

(22) Filed: Jun. 18, 2004

(65) Prior Publication Data

US 2005/0279435 A1 Dec. 22, 2005

(51) Int. Cl.
*A45C 11/18* (2006.01)

(52) U.S. Cl. ..... 150/147; 206/39

(58) Field of Classification Search ..... 150/113, 150/131–135, 138, 139, 142, 148, 150, 147; 206/39; 224/901.2, 901.8, 190, 8, 901
See application file for complete search history.

(56) References Cited

U.S. PATENT DOCUMENTS

| | | | | | |
|---|---|---|---|---|---|
| 45,819 | A | | 1/1865 | Dubber | |
| 658,394 | A | * | 9/1900 | Peters | 150/136 |
| 739,754 | A | * | 9/1903 | Lovece | 150/133 |
| 741,339 | A | | 10/1903 | Hille | |
| 779,742 | A | * | 1/1905 | Schultze | 150/132 |
| 983,383 | A | * | 2/1911 | Manson | 40/388 |
| 1,116,660 | A | | 11/1914 | Willis | |
| 1,228,251 | A | * | 5/1917 | Smith | 150/132 |
| 1,269,427 | A | * | 6/1918 | Aslin | 294/104 |
| 1,326,602 | A | * | 12/1919 | McKey | 150/132 |
| 1,421,883 | A | | 7/1922 | Wright | |
| 1,580,346 | A | * | 4/1926 | Sutter | 150/132 |
| 1,686,756 | A | | 10/1928 | Lorber | |
| 1,833,881 | A | * | 11/1931 | Hughes | 150/132 |
| 1,973,420 | A | * | 9/1934 | Trussell | 150/132 |
| 2,078,935 | A | * | 5/1937 | Downes | 150/132 |
| 2,337,967 | A | | 12/1943 | Broughton | |
| D160,147 | S | | 9/1950 | Chase | |
| 2,550,437 | A | * | 4/1951 | Yates | 150/143 |
| 2,578,390 | A | | 12/1951 | Bastow | |
| 2,643,695 | A | * | 6/1953 | Smith | 150/136 |
| 2,795,259 | A | * | 6/1957 | Nash | 150/152 |
| 3,029,854 | A | | 4/1962 | Burniski | |
| 3,267,980 | A | | 8/1966 | Bird | |
| 3,304,979 | A | * | 2/1967 | Bakken | 150/132 |
| 3,556,188 | A | * | 1/1971 | Thomas et al. | 150/149 |
| 3,970,129 | A | * | 7/1976 | Tepfer | 150/149 |
| 4,010,787 | A | * | 3/1977 | Traugott et al. | 150/132 |
| 4,126,168 | A | | 11/1978 | Ganz et al. | |
| 4,231,135 | A | * | 11/1980 | Fradin | 16/225 |
| D264,022 | S | * | 4/1982 | Wayman | D3/247 |
| 4,586,729 | A | * | 5/1986 | Beylerian | 281/5 |
| 4,843,681 | A | * | 7/1989 | Mannato | 16/380 |
| 4,852,783 | A | | 8/1989 | Bryden et al. | |
| 4,940,068 | A | * | 7/1990 | Pokorny et al. | 150/132 |
| 5,257,656 | A | * | 11/1993 | McLeroy | 150/132 |

* cited by examiner

*Primary Examiner*—Sue A Weaver
(74) *Attorney, Agent, or Firm*—Ogilvy Renault LLP; Paul J. Field

(57) ABSTRACT

A wallet, billfold, business card or credit card holding device for holding flat items including cards and folded paper currency bills having two or more of panels joined with resilient members extending between the peripheral edges of adjacent panels defining one or more openable pockets of a thickness when folded bounded by the panels, where the device is operable between: a secured position where a retention panel resiliently encloses the pocket and impedes insertion and extraction of items from the pocket; and an open position where the retention panel is withdrawn for access to the pocket.

19 Claims, 8 Drawing Sheets

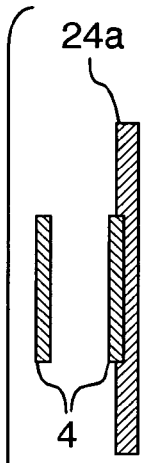
FIG.12
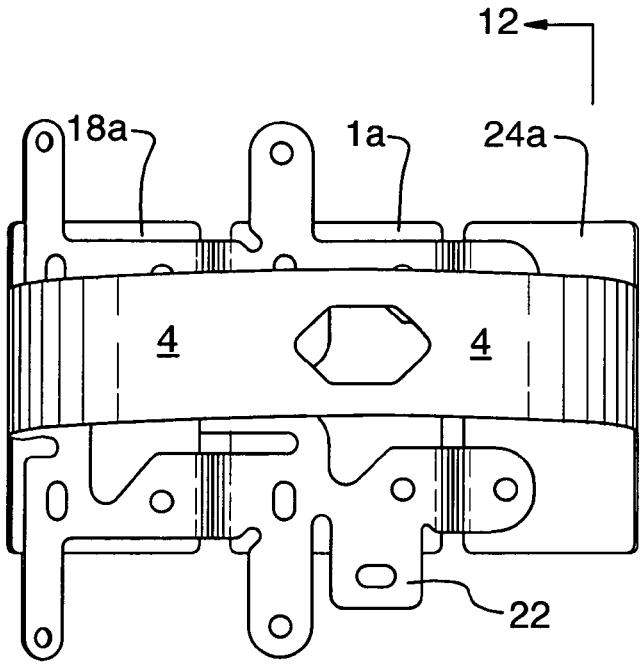
FIG.6
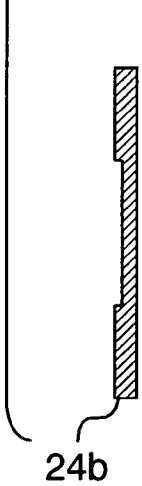
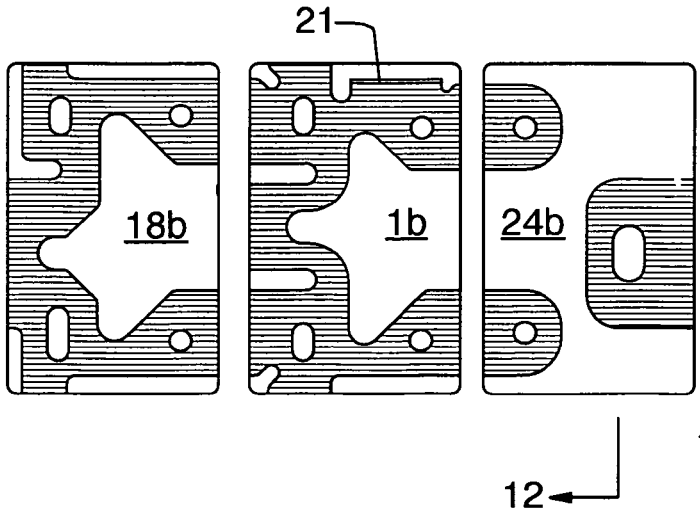

CARD HOLDER AND BILLFOLD

TECHNICAL FIELD

The invention relates to a wallet, billfold, business card or credit card holding device, for holding flat items and folded paper currency bills, having two or more of panels joined with resilient members extending between the adjacent panels defining resiliently openable pockets closed with a retention panel.

BACKGROUND OF THE ART

Wallets, billfolds or credit card holding devices in the prior art are commonly constructed of folded fabrics or leather in various configurations. The size or thickness of many wallets are dictated by the fabric or leather material used. The thickness of the wallet increases substantially once bills and cards are inserted. Prior art wallets include accordion folded sides or resilient members that extend the thickness of the wallet to increase holding capacity.

It is desirable to provide a wallet billfold or credit card holding device that it is of minimal size and weight while maintaining the ability to expand to accommodate a varying thickness of credit cards and currency.

Further objects of the invention will be apparent from review of the disclosure, drawings and description of the invention below.

DISCLOSURE OF THE INVENTION

The invention provides a wallet, billfold, business card or credit card holding device for holding flat items including various cards and folded paper currency bills having two or more of panels joined with resilient members extending between the peripheral edges of adjacent panels defining one or more openable pockets of a thickness when folded bounded by the panels, where the device is operable between: a secured position where a retention panel resiliently encloses the pocket and impedes insertion and extraction of items from the pocket; and an open position where the retention panel is withdrawn for access to the pocket.

DESCRIPTION OF THE DRAWINGS

In order that the invention may be readily understood, one embodiment of the invention is illustrated by way of example in the accompanying drawings.

FIGS. 4-9 are sequential assembly views showing the means by which a device may be assembled.

FIG. 4 shows an initial assembly step with a sheet of resilient rubber material from which resilient members extend together with three first panel laminations in which the resilient sheet is mounted.

FIG. 5 shows an initial assembly step with the resilient sheet bonded to three first panel laminations with adhesive.

FIG. 6 shows the next assembly step where the resilient sheet is looped and has an end secured to the first panel laminations and further shows three second panel laminations with mating etched internal surfaces for assembly of center, left and right sandwich panels with resilient members secured between two panel laminations.

FIG. 7 shows a progression to completion of three panels each comprising two panel laminations between which the resilient sheet is sandwiched.

FIG. 8 shows the next stage where the retention panel and partial panel forming the credit card pocket are assembled sandwiching the resilient member tabs extending from the resilient sheet.

FIG. 9 shows the final assembly of the currency pocket having a relatively short auxiliary panel defining the front wall of the currency pocket together with a relatively wide band of the resilient sheet.

FIG. 12 shows a sectional view along line 12-12 of FIG. 6.

Further details of the invention and its advantages will be apparent from the detailed description included below.

DETAILED DESCRIPTION OF PREFERRED EMBODIMENTS

Figure 1:
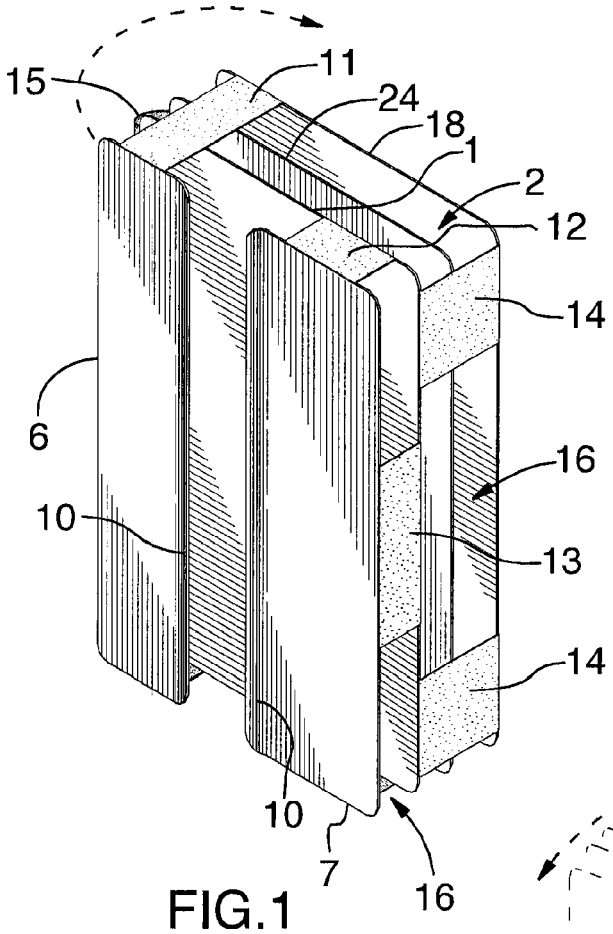
FIG. 1 is a front perspective view of a device according to the invention for holding cards and folded paper currency bills in a secured position and showing with dashed arrow the method of withdrawing the retention panel to open the device.
Figure 2:
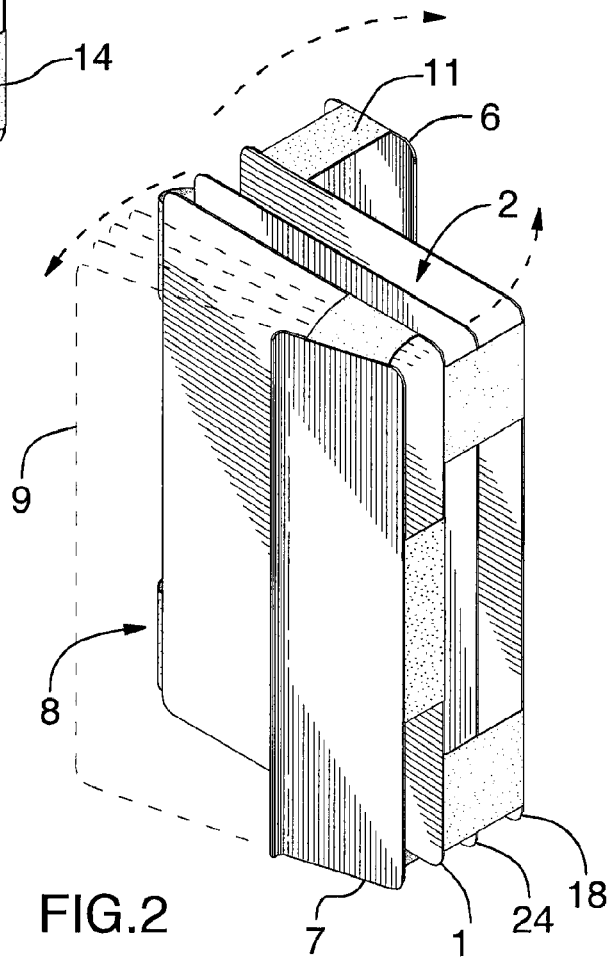
FIG. 2 is a like perspective view of the device shown in an open position where the retention panel is withdrawn and a credit card pocket is open for insertion and removal of credit card items (shown in dashed outline) and showing the unfolding of the currency pocket with dashed arrows.
Figure 3:
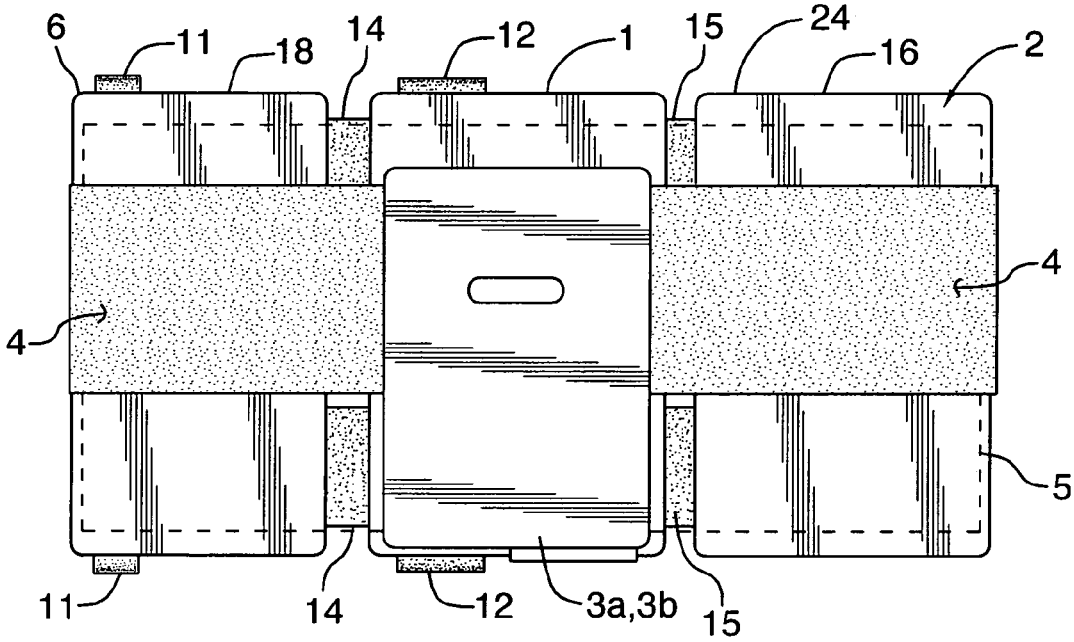
FIG. 3 is an inside view showing the unfolded wallet with currency pocket opened for insertion and removal of paper currency (shown in dashed outline).

FIGS. 1, 2 and 3 show one embodiment of the device according to the invention for holding flat items such as credit cards and folding paper currency bills. FIGS. 4 through 9 show the method of assembly of one example used in the drawings. It will be apparent that various configurations of wallets, billfolds, business card or credit card holders can be designed as well as various assembly methods without departing from the teaching of the invention. The assembly method shown in FIGS. 4 through 9 commences with a flat resilient sheet 20 to which are attached a number of panel laminations to build up laminated panels 1, 3, 6, 7, 18 and 24 where the resilient sheet 20 is held between two matching panel laminations to form individual laminated panels. The panels 1, 3, 6, 7, 18 and 24 may be rigid or semi-rigid relative to the resilient members 11-15 which protects the contents and facilitates folding of currency bills. Other methods of assembly however are within the contemplation of the invention and the illustrated method of assembly comprises an example only.

Referring to FIGS. 1, 2 and 3, the device for holding flat items 9, 5 in the embodiment shown is built up of a number of panels each having a length and a width with an outside peripheral edge, which may vary depending on the function of the panel. Main panels 1 (1*a*, 1*b*, 1*c*) in the example illustrated are of the size and shape of a conventional credit card. As best seen in the open unfolded position of FIG. 3, the three main panels 1 define the back wall of the currency pocket 2 and an auxiliary panel 3 together with a relatively wide band 4 of the resilient sheet define a front wall of the currency pocket 2. In FIG. 3 in dashed outline a currency bill 5 is illustrated which is folded into three substantially equal parts when the device is folded as shown in FIGS. 1, 2.

As seen in FIGS. 1 and 2, further panels include the retention panel 6 and the partial panel 7 which are disposed in a common plane and define a card holding pocket 8.

In FIG. 2 in dashed outline, credit cards 9 are shown in a fanned position within the card pocket 8. The retention panel 6 and the partial panel 7 have an outwardly extending edge 10 curled out beyond the common plane of the panels 6, 7 in order to facilitate gripping and withdrawal of the retention panel 6 by the thumb or fingers of the user. The curled extending edges 10 also facilitate insertion of credit cards or business cards into the card pocket 8 and act as a guide to slide the retention panel 6 over the edges of the other panels.

Extending between the peripheral edges of all adjacent rigid or semi-rigid panels 1, 3, 6, 7, 18 and 24 are a number of resilient members 11-15, that are bent or stretched under tension to define at least one openable pocket such as the part pocket 8 and the currency pocket 2 where each pocket has a thickness bounded by the adjacent panels 1, 3, 6, 7, 18 and 24.

The device is operable between a secured position shown in FIG. 1 and two open positions shown in FIG. 2 to access credit cards or business cards and in FIG. 3 to access currency bills. In the secured position of FIG. 1, the retention panel 6 resiliently encloses the card pocket 8 as well as the currency pocket 2 (see FIG. 3) and impedes the insertion and extraction of items from the pockets such as the credit cards 9 or paper currency bill 5. In the open position shown in FIG. 2, the retention panel 6 is withdrawn. Resilient member 11 is shown in a relaxed position in FIG. 2 and is under tension in FIG. 1 to compress the stack of panels, and any contained cards and currency into a compact package.

It will be understood therefore that in order to withdraw the retention panel 6, a user will engage a thumb or fingers on the upturned edge 10 to slide and rotate the retention panel 6 in the direction of the dashed arrow in FIG. 1 to the withdrawn position shown in FIG. 2, against the tension force of the resilient members 11. The resilient members 11 engaging the retention panel 6 are resiliently stretched when the retention panel 6 is moved between the secured position of FIG. 1 and the open position of FIG. 2. The resilient members 11 under tension as well as resilient members 12 and 13 retaining the partial panel 7 resiliently resist increases in the thickness of credit card pocket 8 as additional cards 9 are inserted and to compress the cards held in the pocket 8

To render the device as small as possible to hold standard credit cards, the panels may be about 2.125 in (53.98 mm) long and about 3.375 in (85.6 mm) wide and 0.03 in (0.76 mm) thick. These dimensions mimic the dimensions of a credit card and also permit three part folding of standard currency bills.

In the configuration shown in FIG. 2, the credit cards 9 are compressed and can be fanned manually by slightly stretching the resilient member 12 and using the resilient member 13 as a hinge to rotate the partial panel 7. In the embodiment illustrated, the partial panel 7 has a width less than the width of the main panels 1. Of course, it will be apparent that the partial panel 7 could be configured with a width less than the width of the main panels 1, 18 and 24 as is the case for example with the auxiliary panel 3 shown in FIG 3. As a result, the cards may be stored long side inward or short side inward depending on the orientation of the partial panel 7.

A further open position regarding the paper currency pocket 2 is shown in the transition shown in FIG. 2 and the position shown in FIG. 3. The main panels 1, 18, and 24 define the currency pocket 2 together with the auxiliary panel 3 and the flexible band 4. In the secured position shown in FIG. 1, the main panels 1, 18, and 24 are overlapped and resiliently wrapped by the retention panel 6 together with the resilient members 11 under tension. In the embodiment shown, the panels 1, 3, 6, 7, 18 and 24 together with various resilient members 11-15 define edge openings 16 about the peripheral edges of the panels 1, 3 6, 7, 18 and 24. The edge openings 16 may be reduced in size by increasing the size of the resilient members 11-15.

Figure 10:
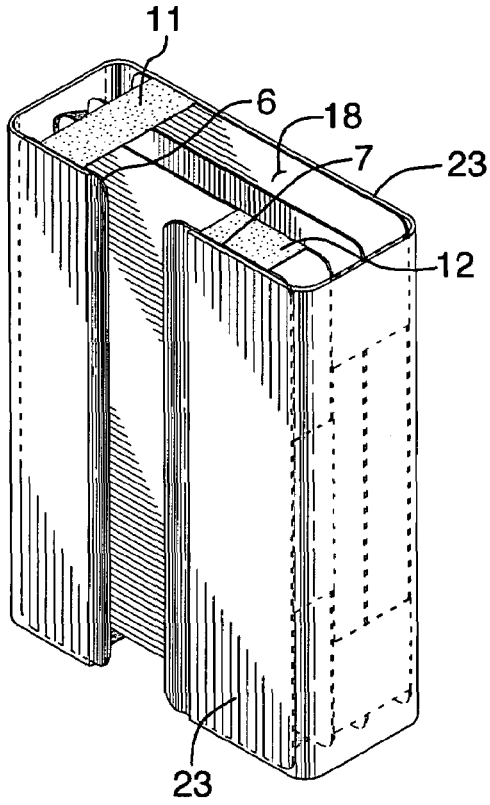
FIG. 10 shows an alternative embodiment in a closed position where the exterior surfaces of the panels are wrapped with an exterior cover sheet of flexible sheet material such as leather, rubber, or fabric.
Figure 11:
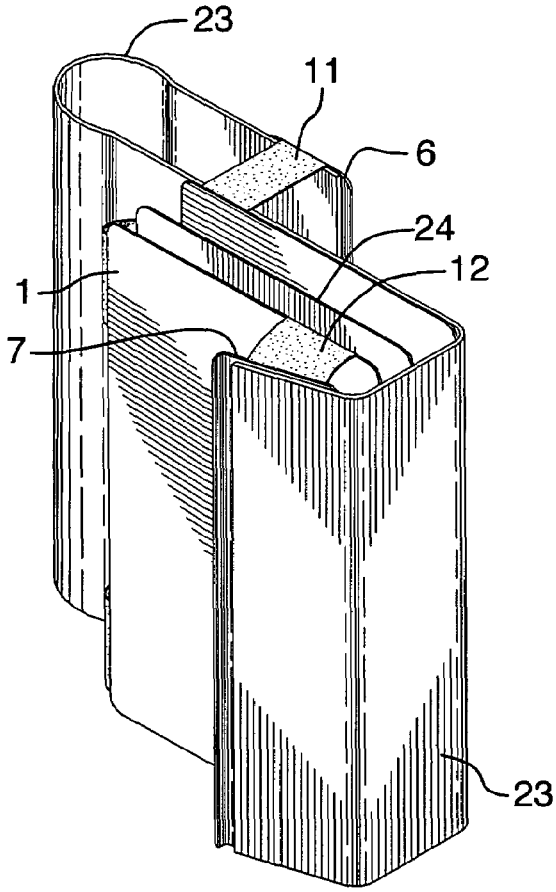
FIG. 11 shows the alternative embodiment of FIG. 10 in an open position.

As shown in FIGS. 10, and 11, to provide a different appearance and functionality, the exterior surfaces of the panels 6, 7, and 18, which face outward in the closed position, may be wrapped with an exterior cover sheet 23 of flexible sheet material such as leather, rubber, or fabric.

FIGS. 4 through 9 show the manner in which the device may be assembled having panels 1, 3, 6, 7, 18 and 24 formed from two or more stacked or sandwiched laminations. It will be apparent that other means of attaching the panels 1, 3, 6, 7, 18 and 24 to the resilient members 11-15 include directly connecting with adhesives, riveting, welding or use of fasteners. Further at least one of the resilient members 11 engaging the retention panel 6 may include a releasable connection (not shown) such as a snap fastener, hook, or Velcro™ type fastening, for example.

In the assembly method described below, the end of the resilient members 11-15 are secured between the two laminations of the laminated panels 1, 3, 6, 7, 18 and 24 with adhesives for example. Further, as described below the ends of the resilient members 11-15 may be mounted on inward facing recesses 17 in the inward surfaces of the lamination 18*a* or may be mounted on inward facing protrusions 19. Use of recesses 17 and protrusions 19 provides mechanical connection between the panels and resilient sheet in addition to any adhesion. In the embodiment illustrated relatively thin panels 1, 3, 6, 7, 18 and 24 are made of two panel laminations 1*a-b*, 3*a-b*,6*a-b*,7*a-b*, 18*a-b* and 24*a-b* of sheet metal such as titanium where the recesses 17 and protrusions 19 are etched in the titanium sheet metal. Further, the resilient members 11-15 may be produced in a single rubber sheet 20 that is die cut or molded as required.

It will be apparent that the example shown on the drawings the rubber sheet 20 has a relatively uniform thickness, however where additional strength or flexibility is required, the relative thickness of individual areas of the rubber sheet 20 may be varied as required. For example, the resilient members 11 may be subject to repeated tension and relaxation whereas other resilient members 12-15 are subjected to a lower level of stress when used as flexible hinges. The resilient members 11 securing the retention panel 6 therefore may be relatively thick or can be produced from different materials depending on the level of stress or wear expected. For example, the resilient members 11 may be constructed from spring steel, resilient fabrics or plastic.

In the simple assembly method shown in FIGS. 4 through 9 however, the rubber sheet 20 is of uniform thickness. The laminations l*a-b*, 3*a-b*, 6*a-b*, 7*a-b*, 18*a-b* and 24*a-b* from which the panels 1, 3, 6, 7, 18 and 24 are constructed have simple mirror image surfaces abutting each other which interlock with the rubber sheet 20 by sandwiching the rubber sheet 20 in the recesses 17 and on protrusions 19 etched within the interior surfaces of the metal laminations l*a-b*, 3*a-b*, 6*a-b*, 7*a-b*, 18*a-b* and 24*a-b*.

Figure 4:
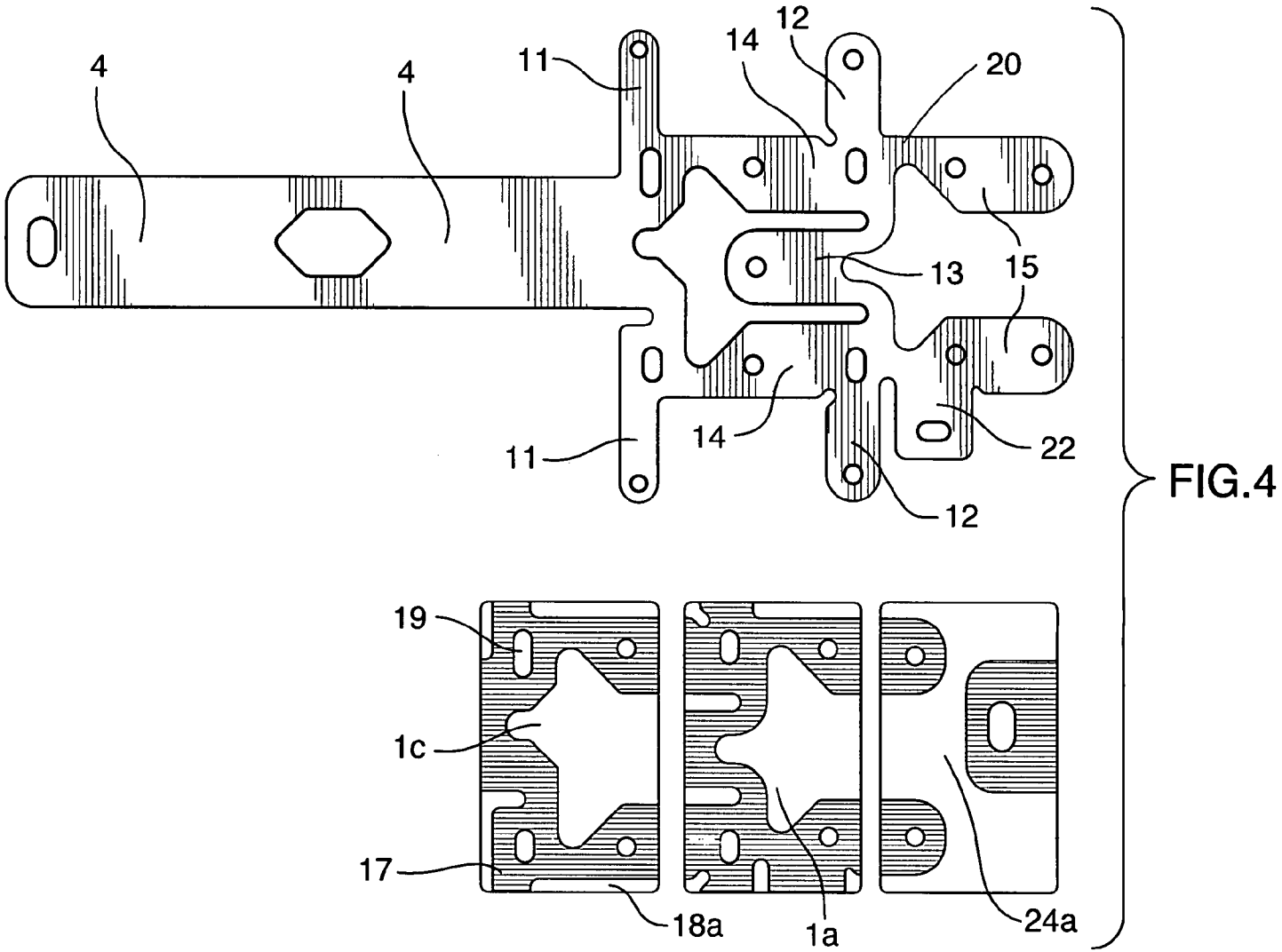
Figure 5:
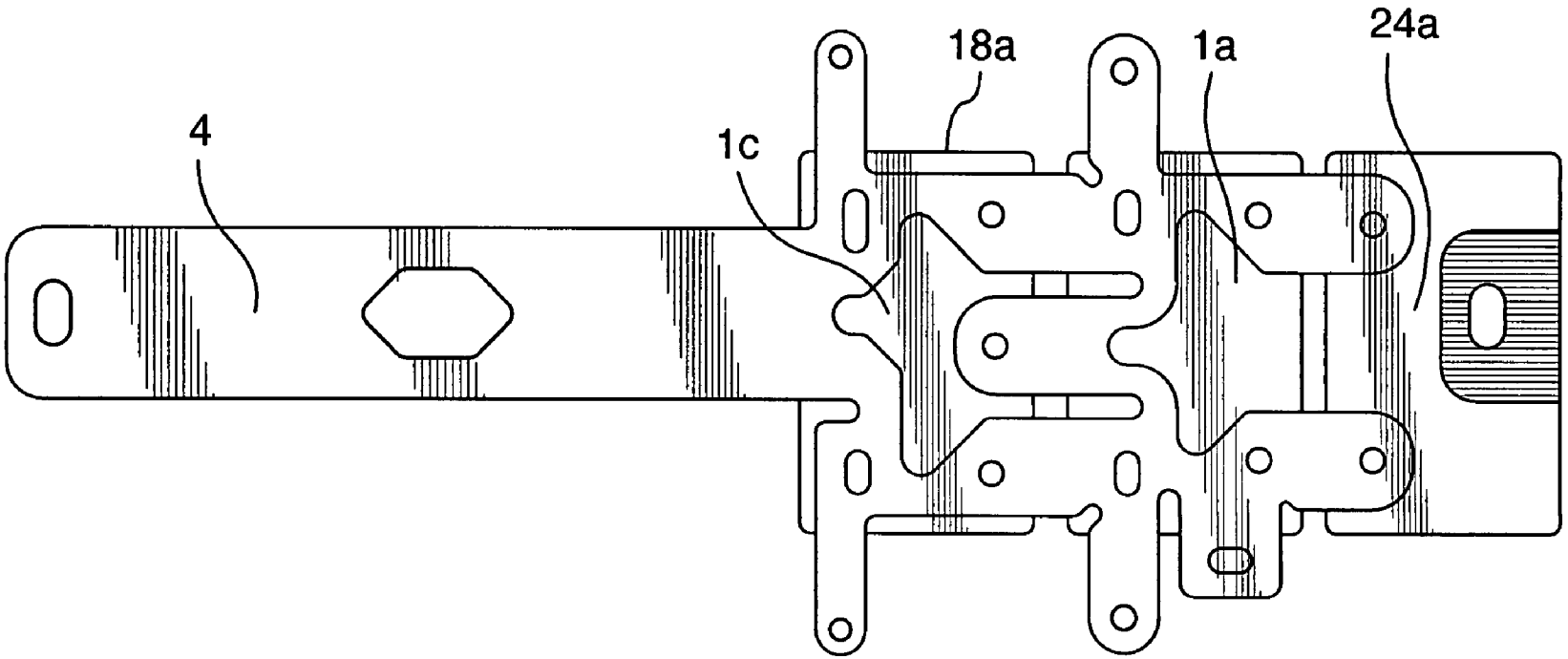
Figure 13:
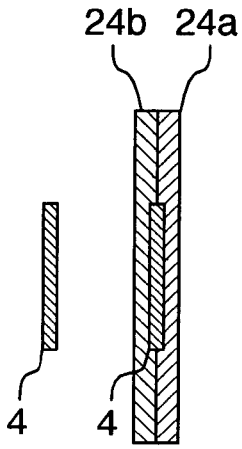
FIG. 13 shows a sectional view along line 13-13 of FIG. 7.

FIG. 4 shows an example having a unitary rubber sheet 20 providing all resilient members 11-15, 22 as well as the flexible band 4. The use of a unitary sheet 20 may be the easiest and least expensive method in some cases. FIG. 4 shows a single lamination for each of the panels 1, 18, and 24 laid out in the relative installed position. The laminations are assembled to the rubber sheet 20 in FIG. 5 having the recesses 17 and protrusions 19 in the laminations that form panels 1, 18, and 24 interlocking with mating openings in the rubber sheet 20.

FIG. 6 shows the next assembly stage where the band 4 is looped around and secured to one lamination forming panel 24. The second lamination l*b*, l8*b*, and 24*b* forming panels 1, 18, and 24 are shown laid out in their position with mirror image protrusions 19 and recesses 17 displayed. The second laminations 1*b*, 18*b*, and 24*b* are mated to the first laminations l*a*, 18*a*, and 24*a* and secure the resilient sheet 20 between laminations with adhesive.

Figure 7:
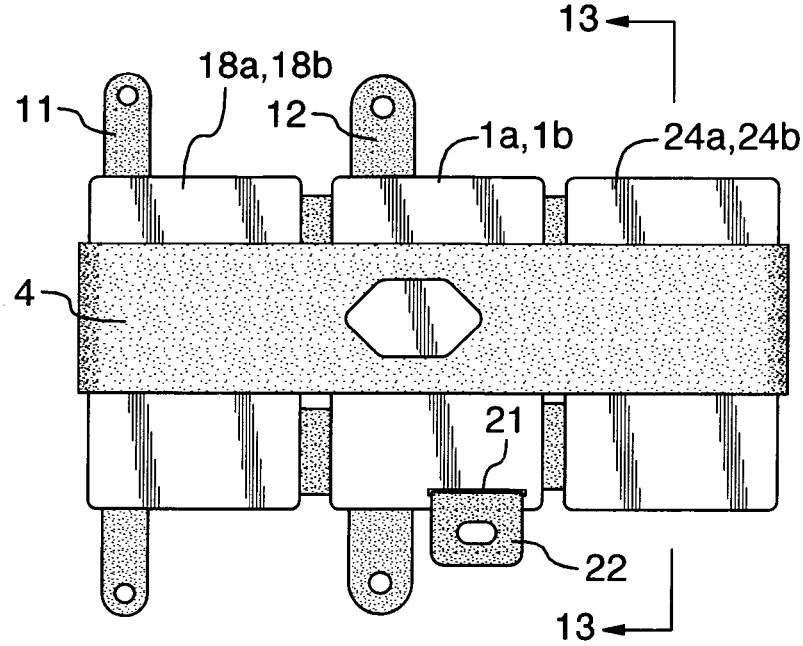

FIG. 7 shows assembly of panels 1, 18, and 24 completed. A slot 21 is provided through which resilient member 22 extends to be secured to the laminations which form the auxiliary panel 3 and sandwich the band 4.

Figure 8:
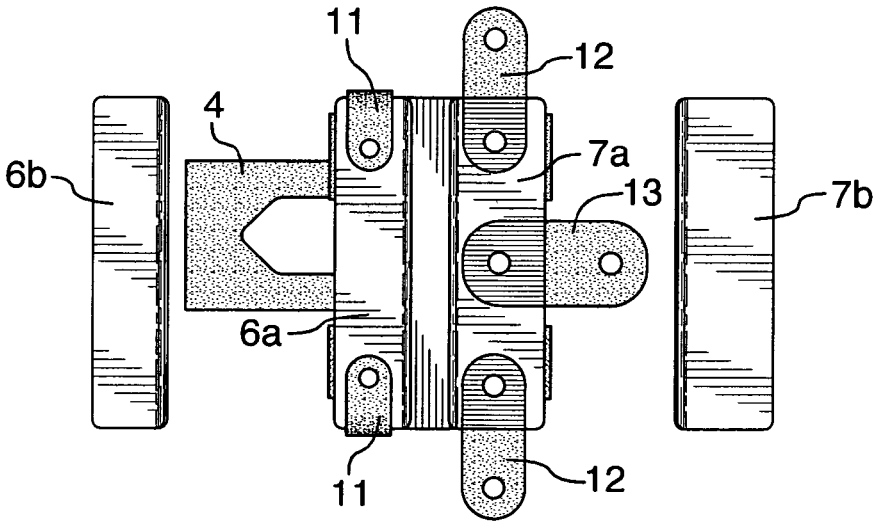

FIG. 8 shows assembly of the laminations 6*a*-*b*, 7*a*-*b*which form the retention panel 6 and the partial panel 7 together with resilient members 11, 12 and 13.

Figure 9:
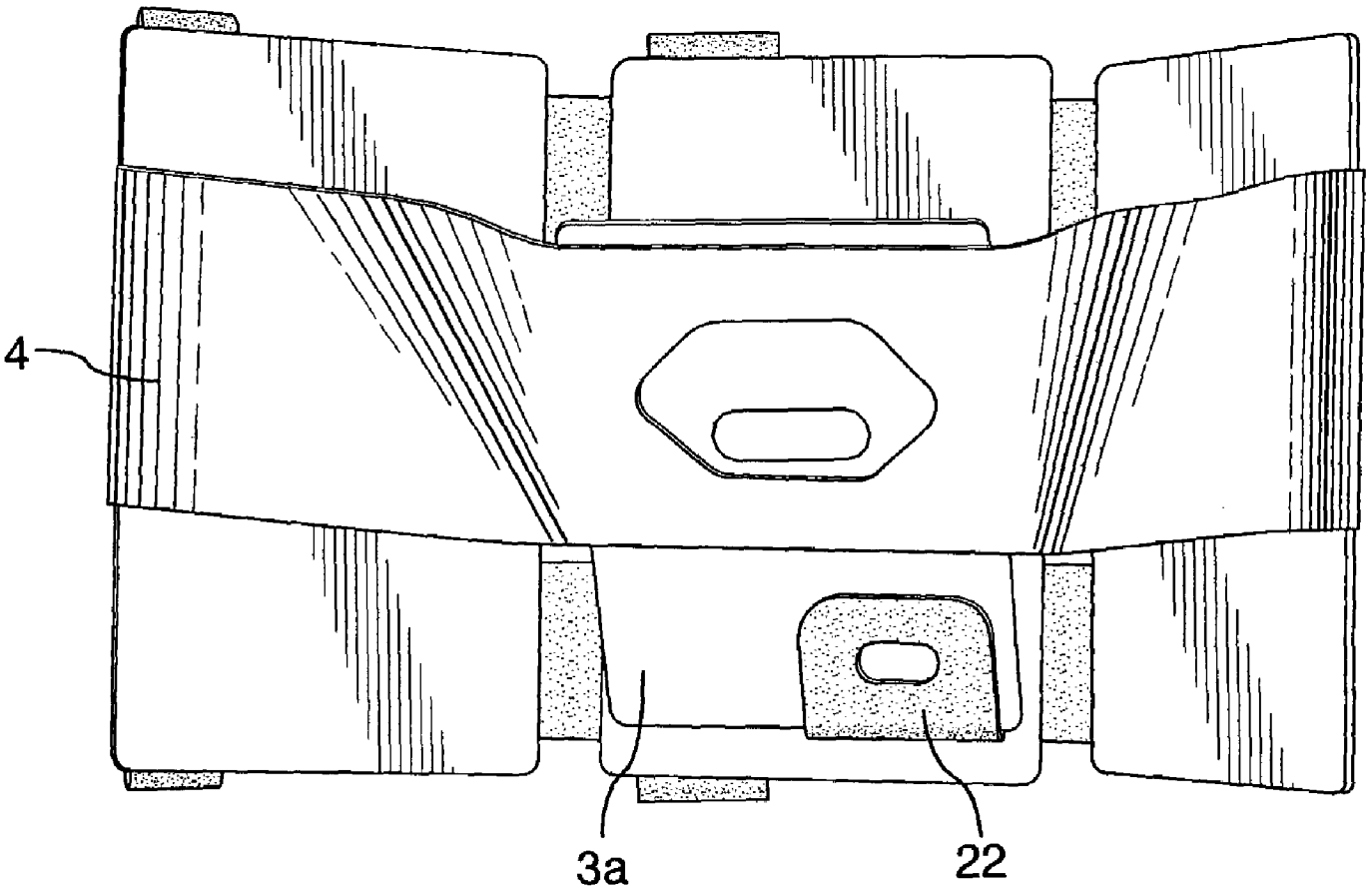

FIG. 9 shows assembly of the resilient member 22 and band 4 to an inside lamination 3*a* which forms the auxiliary panel 3, together with lamination 3*b* shown in FIG. 3. It will be understood that the final assembly includes a mirror image panel lamination 3*b* to complete the assembly of the auxiliary panel 3 and secure the band 4 between two mating laminations 3*a*-*b* with adhesive.

Although the above description relates to a specific preferred embodiment as presently contemplated by the inventor, it will be understood that the invention in its broad aspect includes mechanical and functional equivalents of the elements described herein.

I claim:

1. A device, for holding flat items including at least one of cards and folded paper currency bills, the device comprising:

a plurality of panels having a peripheral edge, said panels including: a retention panel; three main panels, comprising a center panel, a left side panel and a right side panel, the main panels defining a foldable back wall of a currency pocket; and an auxiliary panel defining a front wall of the currency pocket thereby facilitating folding of currency bills along two fold lines into three parts of width and length substantially equal to a width and length of said main panels;

wherein a plurality resilient stretchable members extend:

between a left peripheral edge of the center panel and a right peripheral edge of the left side panel;

between a right peripheral edge of the center panel and a left peripheral edge of the right side panel;

between a left peripheral edge of the left side panel and a left peripheral edge of the auxiliary panel;

between a right peripheral edge of the right side panel and a right peripheral edge of the auxiliary panel;

between a top peripheral edge of the left side panel and a top peripheral edge of the retention panel;

between a bottom peripheral edge of the left side panel and a bottom peripheral edge of the retention panel; and between bottom peripheral edge of the center panel and a bottom peripheral edge of the auxiliary panel;

wherein the device is operable between:

an open position wherein the retention panel is withdrawn; and a secured position wherein the resilient stretchable members extending between the retention panel and left side panel, stretchably clamp the folded currency bills, the center panel, the auxiliary panel and the right side panel between the retention panel and left side panel; and wherein the retention panel resiliently encloses said currency pocket and impedes insertion and extraction of items from said currency pocket.

2. A device according to claim 1 wherein resilient members engaging the retention panel are resiliently stretched when the retention panel is moved between the open and secured positions.

3. A device according to claim 1 wherein the resilient members engaging the left side panel, the center panel, right side panel and auxiliary panel stretch_to accommodate increases in the thickness of the currency pocket and compress the items in the currency pocket.

4. A device according to claim 1 wherein the retention panel has a width and a length at least one of which is less than one of the width and the length of one of the remaining panels.

5. A device according to claim 4 wherein the retention panel and a partial panel are substantially disposed in a common plane, defining a card holding pocket, the partial panel being connected with resilient stretchable members extending:

between a top peripheral edge of the partial panel and a top peripheral edge of the center panel; and between a bottom peripheral edge of the partial panel and a bottom peripheral edge of the center panel.

6. A device according to claim 5 wherein the retention panel and the partial panel have an outwardly extending edge beyond said common plane.

7. A device according to claim 1 wherein the left side panel, the center panel, right side panel and auxiliary panel in the secured position are overlapped and resiliently wrapped by the retention panel.

8. A device according to claim 1 wherein the panels and resilient members define edge openings about the peripheral edges.

9. A device according to claim 1 having at least one of said panels comprising a laminated panel comprising a plurality of laminations.

10. A device according to claim 9 wherein an end of one resilient member is disposed between the laminations of the laminated panel.

11. A device according to claim 10 wherein the end of the resilient member is secured with adhesive between the laminations of the laminated panel.

12. A device according to claim 10 wherein the end of the resilient member is mounted in an inward facing recess in an inward surface of said one said lamination.

13. A device according to claim 10 wherein the end of the resilient member is mounted on an inward facing protrusion on-an inward surface of said one said lamination.

14. A device according to claim 10 wherein laminations have inward surfaces including at least one of: recesses; and protrusions etched therein, thereby mechanically fastening the resilient members and laminations together.

15. A device according to claim 1 wherein the panels comprise metal sheets.

16. A device according to claim 15 wherein the metal is titanium.

17. A device according to claim 1 wherein the resilient members are portions of a unitary rubber sheet.

18. A device according to claim 1 wherein the panels are about 2.125 in (53.98 mm) long and about 3.375 in (85.6 mm) wide.

19. A device according to claim 5 wherein the card holding pocket has a width and length substantially equal to the width and length of said panels.

* * * * *